United States Patent [19]

Lauk et al.

[11] 4,016,812

[45] Apr. 12, 1977

[54] DEVICE FOR CLEANING INK FROM A PRINTING APPARATUS

[76] Inventors: David V. Lauk, 2233 Sussex Lane, Apt. 1010, Indianapolis, Ind. 46219; Lloyd W. Bills, 8268 E. 40th Place, Indianapolis, Ind. 46226

[22] Filed: June 13, 1975

[21] Appl. No.: 586,568

[52] U.S. Cl. ..... 101/425; 15/256.51; 101/156; 101/168

[51] Int. Cl.[2] ..... B41F 35/04

[58] Field of Search ..... 101/136, 168, 425, 417, 101/418; 15/256.51, 256.52, 256.5

[56] References Cited

UNITED STATES PATENTS

| | | | |
|---|---|---|---|
| 1,252,409 | 1/1918 | Dean | 101/168 |
| 1,543,411 | 6/1925 | Wittig | 15/256.5 |
| 2,222,143 | 11/1940 | Farnworth et al. | 101/425 |
| 3,229,661 | 1/1966 | Shelton | 15/256.5 |
| 3,434,273 | 3/1969 | Lovell | 15/256.5 |
| 3,735,702 | 5/1973 | Kossak | 101/425 |
| 3,781,107 | 12/1973 | Ruhland | 101/425 |
| 3,871,081 | 3/1975 | Inoue et al. | 15/256.5 |
| 3,877,371 | 4/1975 | Jaffa | 101/425 |

*Primary Examiner*—Edgar S. Burr
*Assistant Examiner*—William Pieprz
*Attorney, Agent, or Firm*—Woodard, Weikart, Emhardt & Naughton

[57] ABSTRACT

A device for cleaning ink from rollers of a printing apparatus. A container of ink solvent is removably mounted to the printing apparatus. A continuous web extends from the container and against the inked roller(s) of the printing apparatus. The web extends into the container and is directed downwardly by additional rollers into the ink solvent. As the printing apparatus roller is rotated, ink is transferred from the roller onto the continuous web. The web is then engaged by two wiper assemblies and a brush assembly thereby cleansing the ink from the web and allowing the ink to be transferred from the web into the ink solvent.

5 Claims, 6 Drawing Figures

DEVICE FOR CLEANING INK FROM A PRINTING APPARATUS

BACKGROUND OF THE INVENTION

1. Field of the Invention

This invention is in the field of printing.

2. Description of the Prior Art

Many offset duplicating presses have a capability to print only a single color of ink at a time and thus, the printing press must be cleaned prior to the insertion of a different color of ink. Several devices have been provided for cleaning the various rollers within the printing press prior to the addition of a different color of ink. For example, the U.S. Pat. No. 2,832,289 issued to Mitchell discloses a printing press including a roller in contact with an intermediate roller which receives solvent from a solvent container. The U.S. Pat. No. 3,592,136 issued to Selman discloses a cleaning solvent tank which is mounted on a printing press. A cleaning roll is dislosed in the U.S. Pat. No. 3,545,381 issued to Jorgensen. Other patents of interest include the U.S. Pat. No. 3,693,547 issued to Morgan, 3,701,316 issued to Sylvester et al and 3,842,735 issued to Southam et al. Enclosed herein is a new and improved cleaning device which utilizes a continuous web for transferring ink from a roller into an ink solvent tank.

SUMMARY OF THE INVENTION

One embodiment of the present invention is a device for cleaning ink from a roller on a printing apparatus comprising a container for holding ink solvent, mounting means on the container being operable to mount the container to the printing apparatus, a continuous ink transfer web drivingly engaged with the roller, the web contacting the roller as the roller rotates transferring ink from the roller to the web, roller means mounted on the container and in contact with the web being operable to direct the web into the ink solvent, and wiping means mounted on the container and in contact with the web being operable to wipe ink solvent off the web.

Another embodiment of the present invention is a method of cleaning ink from a roller on a printing apparatus comprising the steps of contacting the roller with a continuous web, rotating the roller to drive the web transferring ink from the roller onto the web, directing a portion of the web while the web is being driven by the roller into a reservoir of ink solvent and wiping ink solvent off of the web.

It is an object of the present invention to provide a new and improved device for cleaning ink from at least one roller of a printing apparatus.

An additional object of the present invention is to provide a new and improved method for cleaning at least one inked roller of a printing apparatus.

Related objects and advantages of the present invention will be apparent from the following description.

DESCRIPTION OF THE PREFERRED EMBODIMENT

Figure 1:
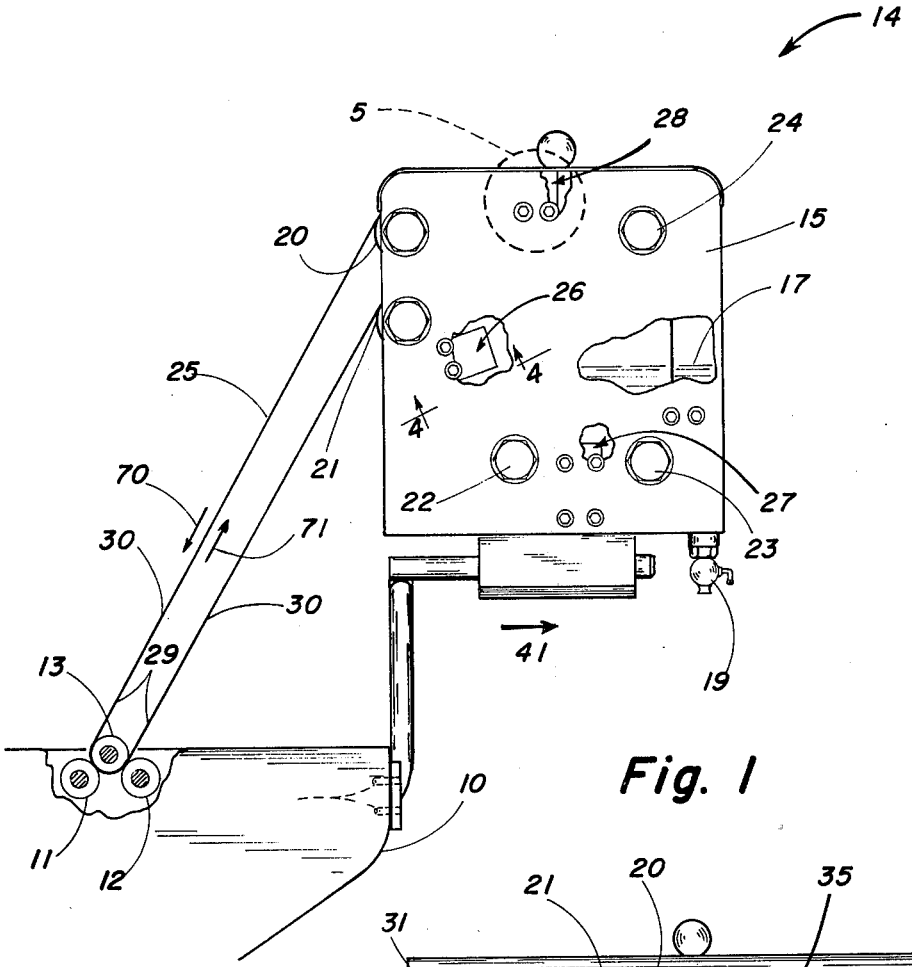
FIG. 1 is an enlarged fragmentary side view of device 14 shown in FIG. 6 used to clean the ink rollers of the printing apparatus also shown in FIG. 6.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications and of the principles of the invention as illustrated therein being contemplated as would normally occur to one skilled in the art to which the invention relates.

Figure 2:
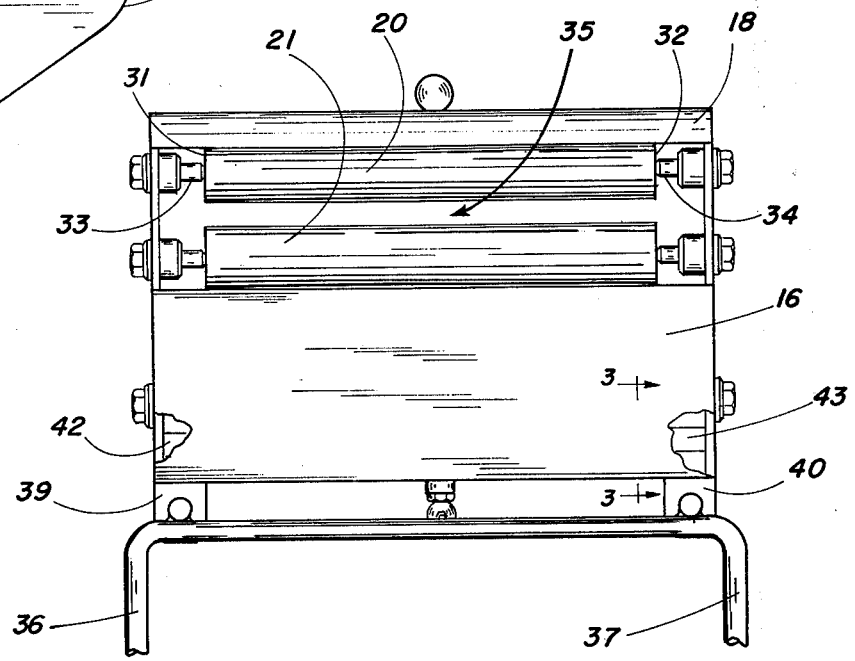
FIG. 2 is a fragmentary front view of the device shown in FIG. 1.
Figure 6:
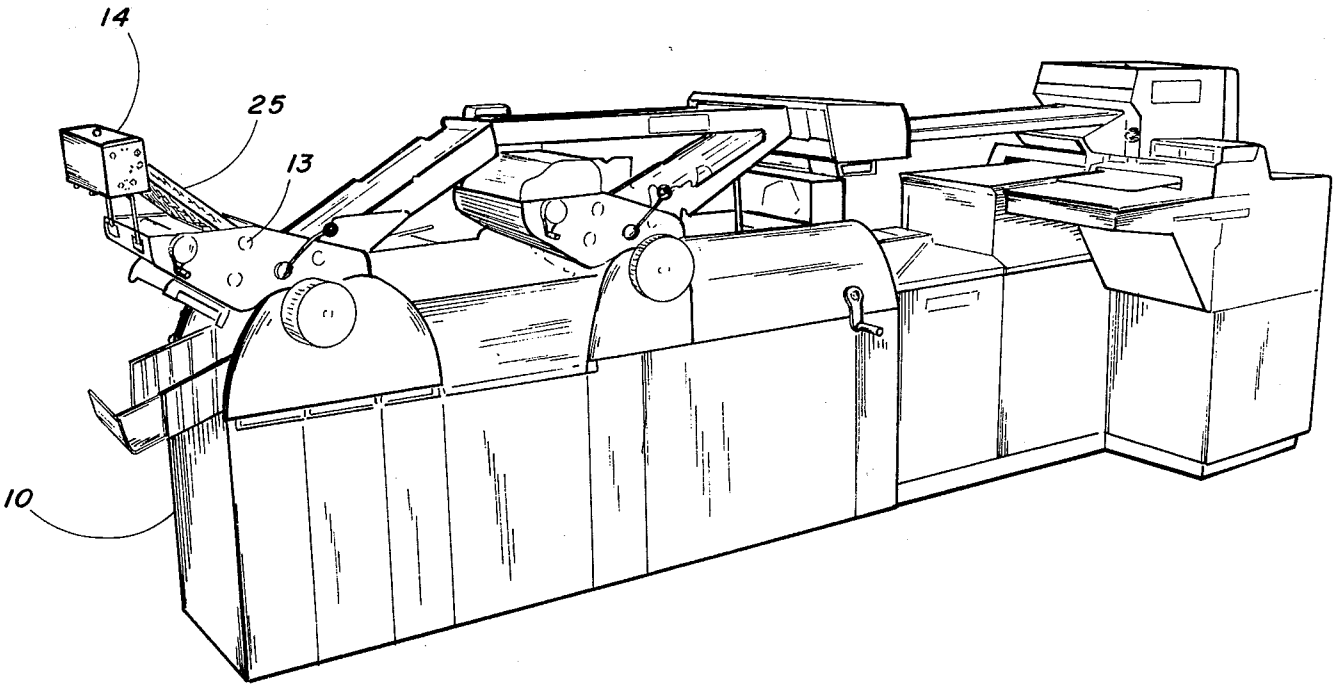
FIG. 6 is a perspective view of a printing apparatus incorporating the present invention.

Referring now more particularly to FIG. 6, there is shown a conventional printing apparatus 10 for producing a variety of printing matter. Device 10 can be an addressograph multilith, offset duplicator, as well as various types of printing presses or duplicators. Certain printing presses can print only a single color at a time and thus, the various rollers of the printing device must be cleaned if a different color of ink is required for the printing of a multi-colored sheet. The sheet is first sent through the press with the sheet being printed with one color. The sheet is then sent back through the press and reprinted with a different color. Typically, printing device 10 includes a pair of transfer rollers 11 and 12 (FIG. 2) rotatably mounted to the frame and driven so as to engage a sheet of paper moving through the machine. A third roller 13 is rotatably mounted to the frame and is positioned immediately above and between transfer rollers 11 and 12. Roller 13 is movably mounted to the frame of the printing device and oscillates as the rollers rotate. In order to clean the ink from rollers 11 and 13, a time period of at least 15 minutes to 30 minutes is required in order to insure that the rollers are completely free of ink. An automatic roller cleaner 14 is shown mounted to printing device 10 for the automatic removal of ink from rollers 11 through 13.

Cleaner 14 includes a container 15 having a generally rectangular box frame 16 (FIG. 2) containing ink solvent 17 (FIG. 1). A removable lid 18 is mounted to the top of frame 16 to facilitate the insertion of fresh ink solvent. A conventional drain 19 is provided at the bottom of the frame to allow for draining of the ink solvent.

Five rollers 20 through 24 are rotatably mounted to and between the side walls of box frame 16 and are engaged with a continuous web or belt 25 which entends partially around roller 13 and is in contact with the ink surfaces of rollers 11 through 13. Wiper assemblies 26 and 28 and brush assembly 27 are mounted within container 15 and are engaged with continuous web 25 to remove the ink and solvent from the web. Thus, as roller 13 is rotated, the web 25 continuously moves through the ink solvent transferring the ink from rollers 11 through 13 to the wiper assemblies and brush assembly which in turn remove the ink and solvent from the web eventually providing clean rollers 11 through 13. The ink from roller 13 is transferred to the inner surface 29 of web 25 whereas the ink from rollers 11 and 12 is transferred onto the outer surface 30 of web 25.

Roller 20 will now be described it being understood that a similar description applies to rollers 21 through 24. Roller 20 (FIG. 2) has a cylindrical configuration with opposite ends 31 and 32 rotatably mounted to a pair of pointed rods 33 and 34 fixedly mounted to the side walls of frame 16. In one embodiment, rods 33 and 34 were produced from a plastic material so as to allow for relatively frictionless motion between the roller and the pointed rods.

Web 30 extends partially around roller 21 with the exterior surface 30 of the web being in contact with roller 21. The web extends from roller 21 to rollers 22 and 23 with surface 29 of the web being in contact with rollers 22 and 23. Both rollers 22 and 23 are located at the bottom of the container thereby being positioned within the ink solvent. The web then extends partially around rollers 24 and 20 with the inside surface 29 of the web being in contact with rollers 24 and 20.

The container is provided with an opening 35 to allow the continuous web to extend into the container and eventually into the ink solvent. When the rollers of the printing device are not being cleaned, web 25 does not extend around roller 13 which is used in conjunction with rollers 11 and 12 to print various matters onto the sheets moving through the printing device. Thus, prior to cleaning rollers 11 through 13, roller 13 is disconnected from the printing device to allow for the positioning of web 25 around roller 13. Roller 13 is then reinstalled in the printing device so as to allow for contact between web 25 and rollers 11 and 12. Likewise, cleaner 14 may be installed or removed from printing device 10 in a relatively easy manner. A pair of tubes 36 and 37 are mounted to printing device 10 by conventional fastening devices. A pair of hollow blocks 39 and 40 are fixedly mounted to the bottom wall of container 15 and slidably receive the top ends of tubes 36 and 37. In order to remove container 15 from the printing device 10, blocks 39 and 40 are moved in the direction of arrow 41 (FIG. 1) so as to disengage from tubes 36 and 37.

Figure 3:
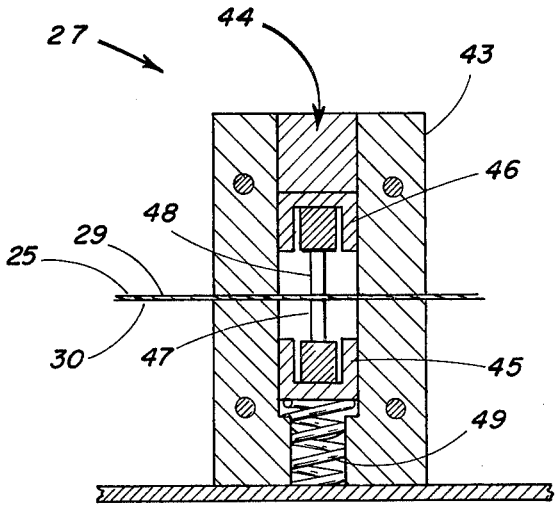
FIG. 3 is an enlarged fragmentary cross sectional view taken along the line 3—3 of FIG. 2 and viewed in the direction of the arrows.

A wiping means is provided on the container and in contact with the web so as to be operable to wipe ink solvent from the web. The wiping means includes a brush assembly 27 mounted to container 15 and within the ink solvent. A cross sectional view of brush assembly 27 is shown in FIG. 3 with web 25 extending therebetween. Brush assembly 27 extends across the width of the web and includes a pair of brush mounted blocks 42 and 43 (FIG. 2) mounted to the opposite side walls of the container. Each brush mounting block includes a groove 44 (FIG. 3) which slidably receives a pair of brush holders 45 and 46 in turn holding a pair of brushes 47 and 48. Brush holders 45 and 46 as well as brushes 47 and 48 extend across the width of the container and the width of web 25. A helical spring 49 is provided in each brush mounting block 42 and 43 urging brush holder 45 upwardly thereby causing brush 47 to be in contact with the bottom surface 30 of web 25. Brush 48 is urged downwardly against the top surface 29 of web 25 by the weight of the brush. Thus, as the web moves through the container, the web will move between and in contact with brushes 47 and 48 with the brushes scrubbing or brushing the ink and ink solvent from the web.

Figure 5:
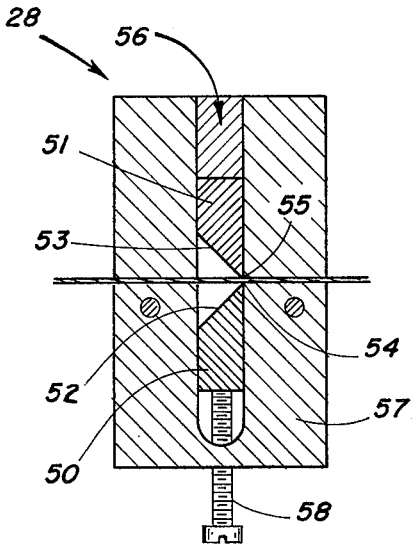
FIG. 5 is an enlarged fragmentary side view of the web wipers located in the area of device 14 identified by circle 5 shown in FIG. 1.
Figure 4:
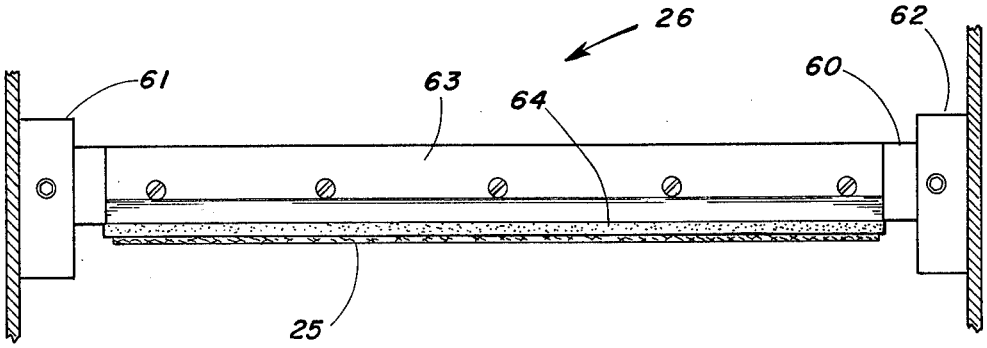
FIG. 4 is an enlarged fragmentary cross sectional view taken along the line 4—4 of FIG. 1 and viewed in the direction of the arrows.

The wiping means further includes a wiping assembly 28 mounted adjacent the top of container 15 and positioned exteriorly of the ink solvent. Wiping means 28 includes a pair of elongated rigid members 50 and 51 (FIG. 5) which extend across the width of the container and web 25. Elongated members 50 and 51 may be produced from a metal with the adjacent ends 52 and 53 being beveled providing a pair of edges 54 and 55 in contact with the opposite sides of web 25 thereby wiping the excess ink and ink solvent from the web. Elongated members 50 and 51 are slidably received in a groove 56 provided in a pair of wiper holder blocks 57 mounted to the opposite side walls of the container. A threaded member 58 extends into groove 56 and abuts against the bottom elongated member 50 to facilitate vertical adjustment of elongated member 50. The elongated members scrape or wipe liquid from the opposite sides of the web.

The wiping means includes a further wiping assembly 26 located exteriorly of the ink solvent. Wiper assembly 26 includes a bar 60 fixedly mounted by holder 61 and 62 between and to the opposite side walls of container 15. A second bar 63 is removably mounted to bar 60. Bar 63 secures a felt strip 64 between bars 63 and 60 with felt strip 64 being in contact with surface 30 of web 25 and located exteriorly of the ink solvent.

The method of cleaning ink from rollers 11 through 13 includes the step of contacting the rollers with a continuous web 25. The rollers are then rotated to drive the web thereby transferring the ink from the rollers onto the web. Web 25 is then directed into container 15 and into the ink solvent 17 while wiper assemblies 26 and 28 and brush assembly 27 wipe the ink solvent from web 25. The ink is brushed from the web while submerged in the ink solvent whereas the ink is wiped off of the web by wiper assembly 28 while the web is located exteriorly of the ink solvent. The wipers and brushes are biased toward and against the opposite sides of web 25.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. Many variations are contemplated and included in the present invention. For example, web 25 may be caused to move either in the direction of arrow 70 or arrow 71.

The invention claimed is:

1. A device for cleaning ink from rollers on a printing apparatus comprising:

a container for holding ink solvent;

a printing apparatus having said container mounted thereon, said printing apparatus includes a frame with at least three rollers of which two are adjacent transfer rollers and with the remaining, removeably mounted third roller normally engaged during printing with said transfer rollers and rotatably mounted to said frame immediately above and between said transfer rollers;

mounting means on said container being operable to mount said container to said printing apparatus;

a continuous ink transfer web extending around and having a first surface in contact with one of said three rollers, said web having a second surface opposite of said first surface with said second surface in contact with two of said three rollers, said web transferring ink from said three rollers to said first surface and said second surface of said web as said three rollers are rotated:

roller means mounted on said container and in contact with said web being operable to direct said web into said ink solvent; and, wiping means mounted on said container and in contact with said first surface and said second surface of said web being operable to wipe ink solvent off said first surface and said second surface of said web;

said wiping means includes a pair of brushes mounted to said container and within said ink solvent, said brushes are spaced apart with said web passing therebetween, said brushes are in contact with said first surface and said second surface of said web brushing ink from said web;

said wiping means further includes a pair of elongated scraping members mounted to said container and located exteriorly of said ink solvent, said members are spaced apart with said web passing therebetween, said members are in contact with said first surface and said second surface of said web scraping liquid off of said web.

2. The device of claim 1 wherein:

said first surface faces inwardly and is in contact with said third roller, said second surface faces outwardly and is in contact with said transfer rollers.

3. The device of claim 2 wherein:

one of said brushes is spring-biased upwardly with another of said brushes gravity-biased downwardly.

4. The device of claim 2 wherein:

one of said scraping members is gravity-biased downwardly with said wiping means including adjusting means operable to adjust the vertical position of another of said scraping members.

5. The device of claim 2 wherein:

said wiping means further includes a fabric strip biased against said first surface and located externally of said ink solvent.

* * * * *